United States Patent [19]

Woods

[11] 4,150,658

[45] Apr. 24, 1979

[54] CIRCULATING-AIR HEATING STOVE

[75] Inventor: Lee Woods, Flagstaff, Ariz.

[73] Assignee: Arizona Forest Supply, Inc., Flagstaff, Ariz.

[21] Appl. No.: 782,631

[22] Filed: Mar. 30, 1977

[51] Int. Cl.[2] ..... F24B 7/04

[52] U.S. Cl. ..... 126/63; 126/72; 126/83; 126/121

[58] Field of Search ..... 126/63, 72, 83, 109, 126/121, 123, 126, 129; 237/51

[56] References Cited

U.S. PATENT DOCUMENTS

| | | | |
|---|---|---|---|
| 1,852,404 | 4/1932 | Elbert | 126/126 |
| 3,880,139 | 4/1975 | Young | 126/126 X |
| 3,981,292 | 9/1976 | Lilly | 126/121 |
| 4,015,579 | 4/1977 | Wirth | 126/63 |

FOREIGN PATENT DOCUMENTS

| | | | |
|---|---|---|---|
| 1084472 | 7/1954 | France | 126/83 |
| 529415 | 11/1940 | United Kingdom | 126/72 |

*Primary Examiner*—Robert G. Nilson
*Attorney, Agent, or Firm*—LaValle D. Ptak

[57] ABSTRACT

A circulating-air, woodburning, heating stove/fireplace combination has a combustion chamber for burning fuel. The back of the stove has an inner wall defining the combustion chamber and a spaced outer back wall forming an air chamber between the two walls. An air inlet is provided at the bottom of the air chamber, and an electric fan or blower is attached to the inlet to force air into the space between the walls at the bottom. This air then passes upwardly in the airspace between the back walls and exits through several parallel heat tubes which extend across the top of the fire chamber. These heat tubes open at the front of the stove, so that the air forced through the airspace by the fan is moved into the room. A baffle is provided above the heat tubes to create turbulence in the combustion products for improving the heat exchange of these products with the air moving through the heat tubes prior to the discharge of the combustion products through a flue located in the top of the stove.

9 Claims, 9 Drawing Figures

CIRCULATING-AIR HEATING STOVE

BACKGROUND OF THE INVENTION

With the advent of central heating systems and abundantly available and relatively inexpensive fossil fuels, the old-fashioned "pot-bellied" stoves which formerly were used to provide heat have fallen into disuse. Central heating systems offer a distinct advantage over individual heating stoves located in each room which a person desires to heat. Furthermore, central heating systems can be hidden away out of view from the rooms to which they supply heat. In addition, such systems, even coalfired systems, are relatively easy to clean and to maintain. As a consequence, up until recently, there has been little interest in wood burning heating stoves, particularly those which are located within the room which is to be heated. This has been true even for remote cabins or cottages since bottled gas or petroleum fuels have been available in abundant quantities for use with the heating plants of such buildings.

At the present time, however, it is becoming abundantly clear that the fossil fuels which have been used to such a great extent over the past few decades are in dangerously short supply. Furthermore, these fuels are obtained from nonreplenishable sources; and at the present rate of consumption, it is readily apparent that other alternatives to the use of these fuels for producing energy must be found. In addition, the costs of fossil fuels are rapidly increasing, so that they no longer are the bargin source of energy which they were only a few years ago.

Because of increasing awareness of the finite quantity of fossil fuels available and because of the increasing costs of these fuels, substantial interest is being directed toward finding other sources of energy to replace the fossil fuel consumption which has become so widespread over the past few decades. One source of fuel which is present in large quantities and which is a replenishable source is wood. When forests are properly managed, they produce a continuous supply of wood for various uses, one of which is fuel.

Thus, there now is an increasing interest in wood burning stoves for heating small buildings and remotely located buildings as well as interest in using wood burning stoves in applications where presently fossil fuel central heating systems are commonly employed. The wood burning stoves commonly employed, however, generally are extremely inefficient as heating sources. Most of them rely upon radiations and convection currents of air within the room coming into contact with the outside walls of the stove to produce heated air. In such stoves the major portion of the heat produced by the combustion of the wood or other combustible products in the stove is lost with the combustion products out the flue or smoke stack. This is one of the greatest drawbacks of self-contained room size wood burning stoves. In addition, the room itself is not uniformly heated. The region immediately adjacent the stove is too hot, while the more remote corners or sides of the room obtain relatively little heat from the stove.

Some early models of wood burning heating stoves, in attempts to overcome the inefficiency of such stoves, relied upon rather extensive baffles between the upper portion of the combustion chamber and the outlet for the flue in order to force the combustion products to take a tortuous path from the upper portion of the combustion chamber to the flue. This resulted in retention of more heat within the stove and an improvement in radiation of this heat from the stove. The operation, however, is still relatively inefficient and a large amount of heat loss results.

Another early wood burning stove had a double wall along at least a portion of the fire chamber to create an air chamber heated on one side by one of the walls of the fire chamber. An air inlet was provided near the bottom of this air chamber and appropriate air outlets were created near the top. Air rose by convection current through the air chamber and out the outlets. Thus, this air was heated in addition to the air coming in contact with the outside of the stove. Improved efficiency did result, but the bulk of the heat generated by the process of combustion still was lost in the flue.

In addition to the foregoing disadvantages, most wood burning stoves are rather obtrusive and unattractive. It is desirable to provide a wood burning stove with an appearance approximating that of a fireplace and useable as a fireplace, so that it can perform a function of attractiveness as well as utility in the room in which it is used. In addition, it is desirable to provide a wood burning stove with improved efficiency; so that a greater portion of the heat generated by the wood or other fuel burned in the stove is utilized to heat the room in which the stove is used.

SUMMARY OF THE INVENTION

Accordingly, it is an object of this invention to provide an improved heating stove.

It is another object of this invention to provide an improved wood burning heating stove.

It is an additional object of this invention to provide an improved wood burning heating stove utilizing recirculating air flow therethrough.

It is a further object of this invention to provide an improved wood burning heating stove which may be used as a stove or as a fireplace.

It is yet another object of this invention to provide an improved efficiency wood burning heating stove.

In accordance with the preferred embodiment of this invention, a free standing wood burning heating stove has a combustion chamber with the back wall spaced inwardly from the ends of the bottom, top and side walls. An auxiliary back wall is spaced from the back wall of the combustion chamber and attached to the top, bottom and side walls to provide an airspace between the two walls for the passage of air to be heated from an inlet near the bottom of the airspace outwardly through heat tubes extending across the upper portion of the combustion chamber to exit through holes in the front wall of the heating stove. A large opening is provided in the front wall of the combustion chamber to permit the loading of wood or other fuel into the stove, and this opening is closed by a pair of doors which are pivotally hinged at opposite sides of the opening. The door hinge configuration is such that when the doors are opened, they may be folded back along the sides of the heating stove; and with a fireplace screen in place, the stove may be used as a fireplace. A baffle is provided above the heat tubes to create turbulence in the combustion products rising upwardly past the heat tubes and to increase the heat exchange between the heat of the combustion products and the air passing through the heat tubes. An electric fan or blower is used to move air through the opening in the air chamber at the rear of the stove and outwardly through the heat tubes. With the doors open, the stove also may be used as a fireplace.

DETAILED DESCRIPTION

Figure 1:
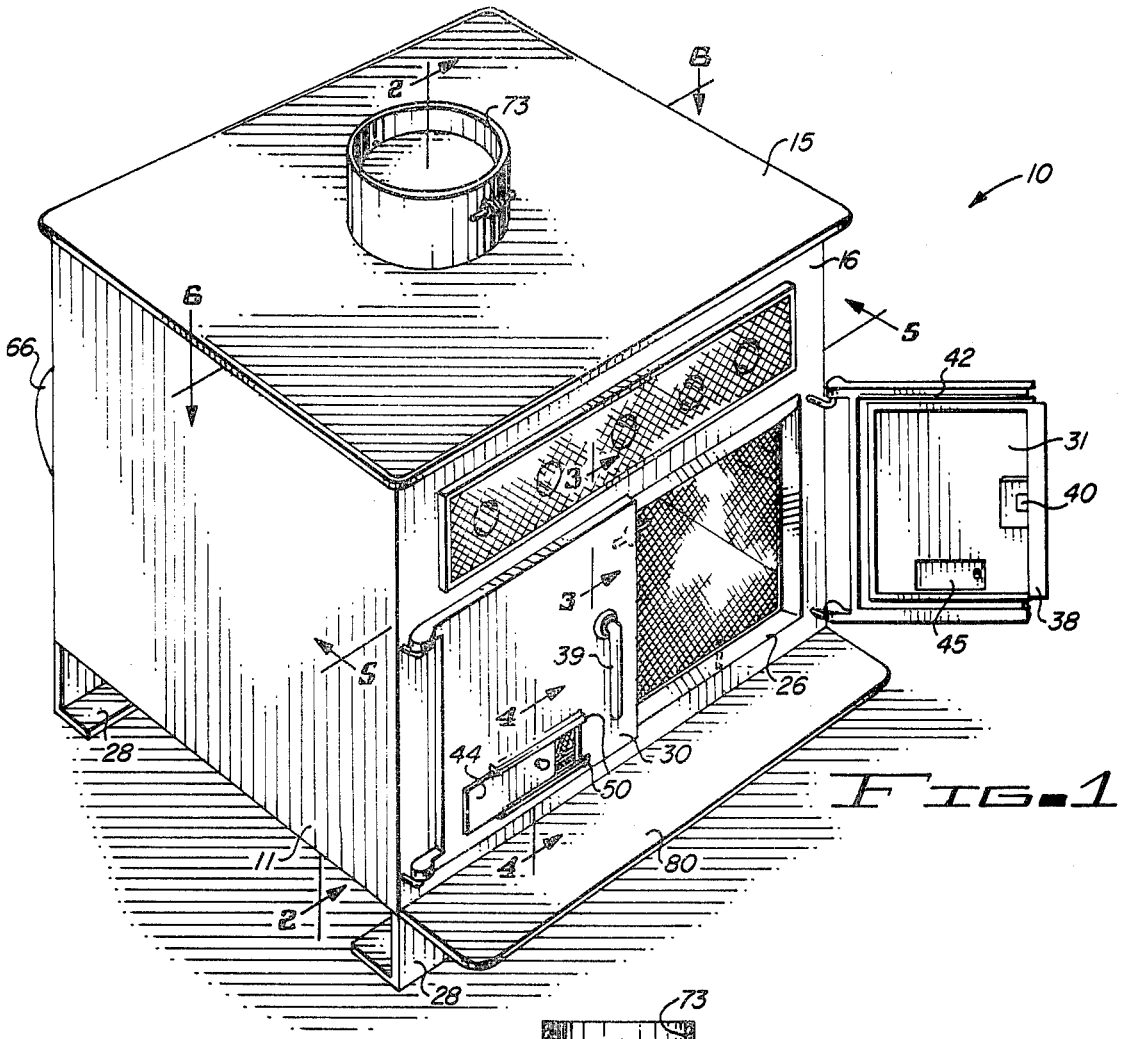
FIG. 1 is a perspective view of a preferred embodiment of the invention.

Referring now to the drawings, the same reference numbers are used throughout the several figures to designate the same or similar components.

FIG. 1 is a perspective view of a preferred embodiment of a free-standing wood burning heat stove/fireplace combination unit 10. The heating stove unit has a combustion chamber which is formed of a pair of side walls 11 and 12, a bottom 14, a top 15 and a front wall 16. The rear of the combustion chamber is closed off by a rear wall 18 which is spaced inwardly from the ends of the top, bottom and side walls (as seen most clearly in FIG. 2). An auxiliary rear wall 21 closes off the opening formed at the ends of the top, bottom and side walls to form an air chamber 24 between the wall 18 and the wall 21 at the rear of the combustion chamber of the stove.

The front wall 16 of the stove has a large rectangular opening in it (as seen most clearly in FIG. 1), and this opening has a flange 26 extending around all four sides. The opening provides ready access to the interior of the combustion chamber to permit the loading of wood or other fuel into it and to permit the removal of ashes and other residual products of combustion from the stove from time to time. To prevent excess heat from being radiated through the bottom of the stove 14, refractory brick or other suitable refractory material 27 is used to line the bottom of the stove and the lower portion of the combustion chamber (as seen most clearly in FIGS. 2 and 5). The use of the refractory material 27 permits the stove/fireplace unit 10 to be built as a low profile unit which may be placed on or very near the floor of the room in which the stove is used. As illustrated, four relatively short L-shaped legs 28 are provided to hold the stove combustion chamber a few inches off the floor of the room in which it is used.

Figure 8:
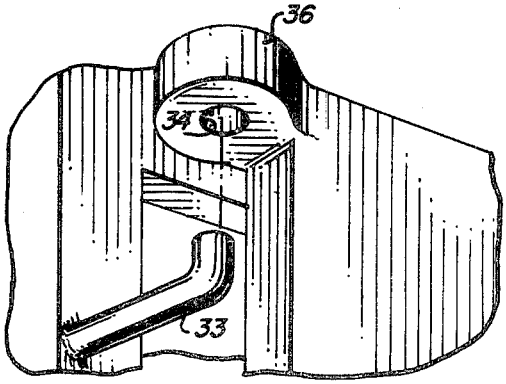
Figure 6:
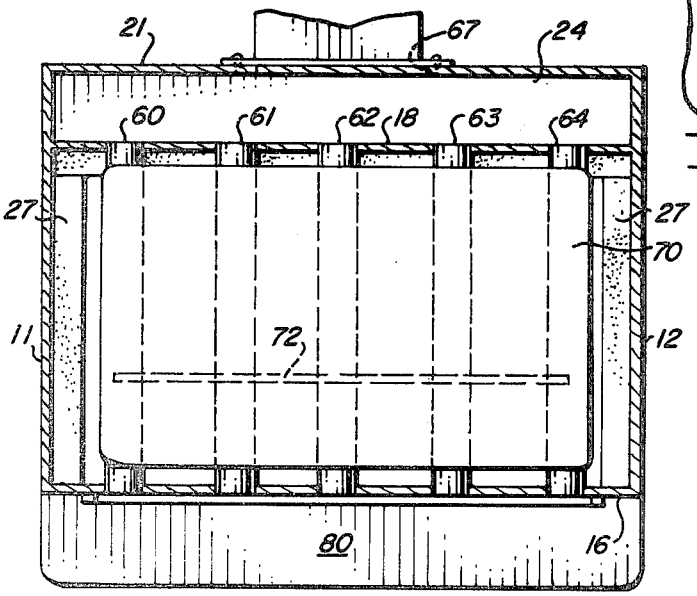
FIG. 6 is a partially cut-away top view of the embodiment shown in FIG. 1.

To permit use of the stove as a more or less conventional heating stove, or optionally, as a fireplace, a pair of fold-back doors 20 and 31 are used to selectively close the opening in the front of the combustion chamber. Preferably, these doors are made of cast iron or other suitable material and they are pivotally hinged at the outer edges of the front wall 16 of the stove on conventional offset pin and socket hinges comprising an L-shaped pin 33 which extends into a socket 34 on an offset ear 36, one of which is located at the upper and lower edge of each of the doors 30 and 31. The details of this hinge arrangement are shown in FIG. 8.

In FIG. 1, one of the doors, the door 30, is shown closed while the door 31 is illustrated in a partially open position to expose the opening into the combustion chamber through the front wall 16. Both of the doors 30 and 31 can be folded all the way back to lie substantially parallel to the sides 11 and 12, respectively, when the unit is used as a fireplace. The offset ear 36 and the location of the pin 33 permits this out-of-the-way positioning of the doors to take place. The door 31 has a flange 38 on it which, in the closed position, lies behind the right-hand edge of the door 30. A handle 39 is provided on the door 30 and is rotated into position to place a projection (not shown) on the inside side of the door 30 behind the door 31 to rest on a pin 40 to thereby lock the two doors into place in a closed position. To open the doors, the handle 39 is rotated in a counterclockwise direction, the door 30 is first pulled open; then the door 31 may be pulled open to fully expose the opening into the combustion chamber through the front wall 16.

Figure 3:
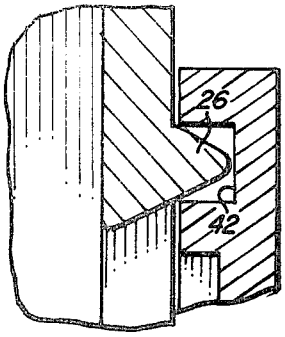
FIG. 3 is a detailed view of a portion of the embodiment shown in FIG. 1.
Figure 4:
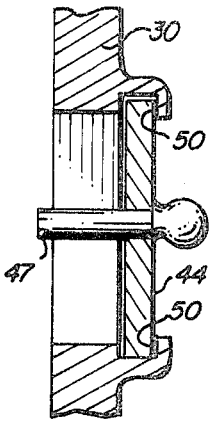
FIG. 4 is a cross-sectional detail of another portion of the embodiment shown in FIG. 1.

When the doors 30 and 31 are closed, a mating channel 42, which extends around the top, bottom and the outer edges of these doors, overlies and engages the flange 26 formed around the combustion chamber opening. This effectively seals the opening and prevents flames and combustion products from passing outwardly around the doors when they are in the closed position. The manner in which the flange 26 cooperates with the channel 42 to accomplish this seal is illustrated in the detailed view of this portion of the assembly in FIG. 3.

To control the combustion of the wood or other fuel in the stove when the doors 30 and 31 are closed, a pair of sliding draft controls 44 and 45 are provided in the doors. These draft controls each have a pin 47 extending through them to engage opposite edges of a rectangular opening at the lower side of each of the doors in either the closed or fully open position of the draft controls. The pin 47 is placed through the draft control 44 after it is assembled in place in a slide channel set 50 to prevent loss or removal of the draft control 44 in the fully assembled stove unit. The amount of air permitted to enter the combustion chamber when the unit 10 is used as a heating stove is controlled by the openings of the draft controls 44 and 45 and can be varied from a fully closed position of both draft controls through any number of intermediate positions to a fully open position of both draft controls.

Figure 9:
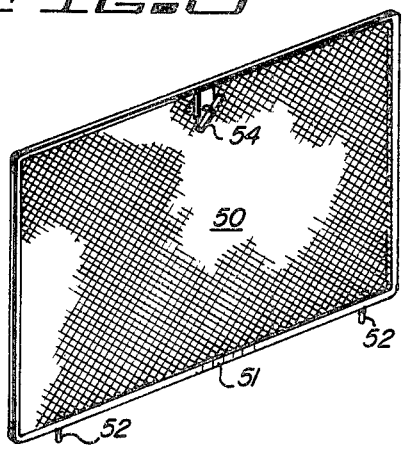
FIG. 9 is a perspective view of a screen which may be used in conjunction with the embodiment shown in FIG. 1.

When both of the doors 30 and 31 are fully opened and folded back out of the way, a fireplace screen 50 (FIG. 9) may be inserted into the opening to function in a conventional manner. The screen 50 is defined by a rigid frame 51 which has a pair of inwardly extending L-shaped feet 52 located on its backside. These feet extend over the lower lip of the combustion chamber opening, as illustrated in FIG. 1, and a simple rotating handle 54 carrying a projection (not shown) on its inner side is used to move the projection into engagement with the inner side of the combustion chamber to hold the screen 50 in place. The screen may simply be removed by rotating the projection on the inner side of the handle 54 out of engagement with the inside of the combustion chamber, tilting the screen outwardly, and lifting it up out of the way. The configuration of the handle 54 and the outside dimensions of the frame 51 of the screen are selected so that the screen engages the outside edges of the flange 26 to prevent it from being pushed inwardly into the combustion chamber. The amount by which the handle 54 extends out of the plane of the screen 50 is unimportant since the screen 50 is removed when the doors 30 and 31 are closed.

The heating stove/fireplace unit which has been described thus far is effective to provide both modes of operation, that is, operation as a heating stove or a fireplace. The efficiency of the stove which has been just described, however, is substantially improved by the utilization of the air chamber 24 at the rear of the stove cooperating with five heat tubes 60, 61, 62, 63 and 64 extending from corresponding circular openings in the back wall 18 of the combustion chamber to corresponding circular openings in the upper portion of the front wall 16 of the combustion chamber. FIGS. 1, 2, 5 and 6 illustrate the location and cooperation of the heat tubes 60 through 64 with these other portions of the stove/-fireplace unit.

A blower, which preferably is in the form of a relatively small electric motor/fan combination 66 is used to move air into the chamber 24 through an opening 67 located at the lower rear side of the auxiliary wall 21. Because of the right angle air flow passage formed between the outlet of the motor/fan 66 and the chamber 24, substantial turbulence is created in this air flow. This is highly desirable to obtain maximum heating of the air passing upwardly through the chamber 24 from the heated back wall 18 of the combustion chamber. This air is further heated as it passes through the heat tubes 60 through 64 located immediately above the source of burning fuel in the combustion chamber and exits through a decorative screen 68 placed over the five openings in the front wall 16 which terminate the ends of the heat tubes 60 through 64.

Figure 2:
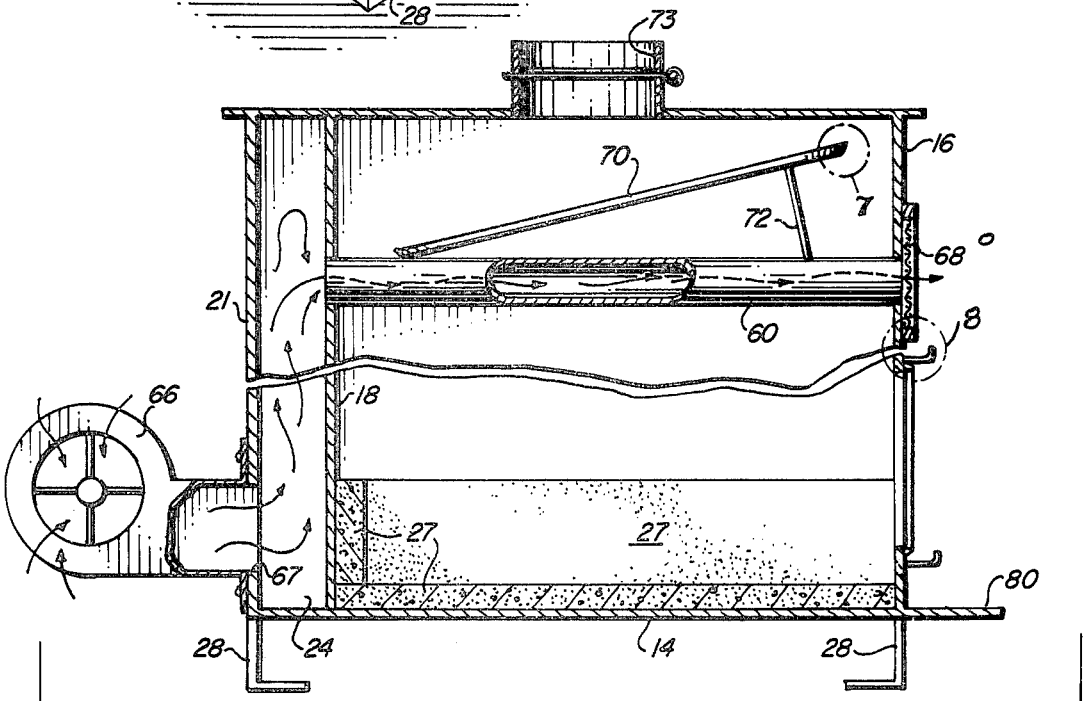
FIG. 2 is a sectional view of the embodiment shown in FIG. 1, with the doors removed.
Figure 5:
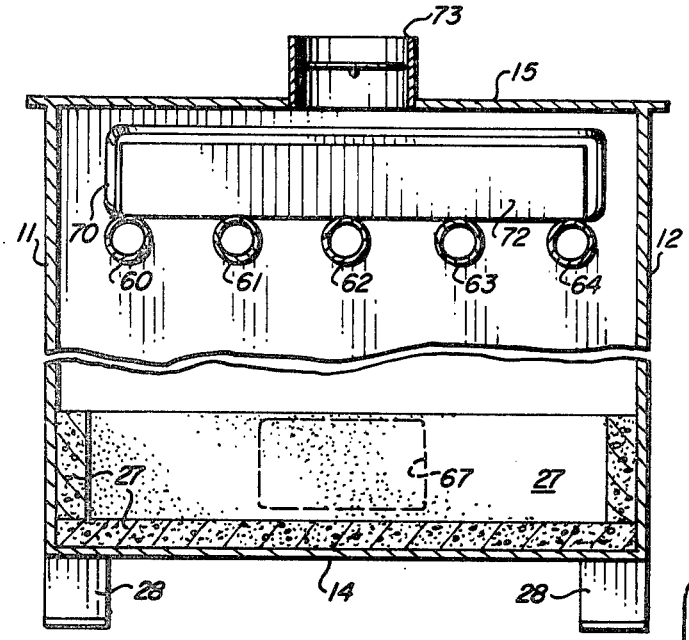
FIG. 5 is a partially cut-away front view of the embodiment shown in FIG. 1.

To further increase the transfer of heat generated in the combustion chamber to the air flowing through the tubes 60 through 64, a rectangular baffle 70 is placed at an acute angle from front to back of the heating unit above the tubes 60 through 64. As shown in FIGS. 2 and 5, the rear edge of this baffle is attached in a suitable manner, such as by welding, to the upper surfaces of the tubes 60 through 64 and extends upwardly at an acute angle under the support of a flange 72, the upper edge of which is attached to the heat tubes 60 through 64. The space defined by the flange 72 and the lower side of the baffle 70 creates substantial turbulence in the combustion products rising upwardly from the fire located within the combustion chamber, and causes these combustion products and the rising heat to be circulated around the heat tubes 60 to 64 prior to escaping around the front, side and back edges of the baffle 70 to ultimately exit through the stove pipe or flue 73.

Figure 7:
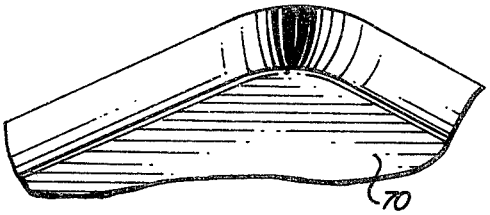
FIGS. 7 and 8 are detailed views of features of the embodiment shown in FIGS. 1 and 2.

It has been found that bevelling the lower edges of the baffle 70 (as seen most clearly in FIG. 7) permits the smoke to pass smoothly by the baffle 70 without any discharge out through the opening in the front wall 16, even when the unit is used in its fireplace configuration.

In a stove/fireplace unit 10 which has been constructed, highly efficient heating has been obtained with a unit in which the front, back and side walls are 23½ inches high, the side walls are 19 inches deep and the inner wall 18 of the combustion chamber is spaced two inches from the outer wall 21 of the unit. The width of the front and back walls 16, 18 and 21 is 24 inches. The heat tubes 60 through 64 are of two inch outside diameter and are spaced 3½ inches from the underside of the top 15. These tubes are evenly spaced from one another, and the outside tubes 60 and 64 are four inches from the side walls 11 and 12 respectively. As seen most clearly in FIG. 6, the outside edges of the baffle plate 70 coincide with the outside edges of the outermost tubes 60 and 64. The flue 73 is 8 inches in diameter and it is centered in the top of the stove. The width of the baffle plate 70 from front to back is 12¾ inches, and the support 72 holds the front edge of the baffle plate 70 1½ inches above the tubes 60 through 64. Thus, the baffle plate extends upwardly from the heat tubes at an angle less than 15 degrees. These dimensions are not intended to be limiting but merely illustrative of a successful implementation of an embodiment of the invention.

To prevent the spillage of ashes onto the floor in front of the unit, an ash fender 80 extends outwardly from the bottom of the unit about 5 or 6 inches. This ash fender 80 may be an extension of the bottom 14 or may be separately attached to the bottom 14 by any suitable means, such as welding or the like.

To produce maximum heat with the doors closed, the damper in the upper stack 73 is completely closed and the draft controls 44 and 45 are almost closed. The stove does not smoke when used this way. The heating stove/fireplace unit 10 which has been described above is a highly efficient wood burning unit capable of producing a maximum amount of heat from a minimum consumption of wood or other combustible fuel. Various modifications will occur to those skilled in the art without departing from the true spirit and scope of the invention.

I claim:

1. A free-standing heating stove including in combination:

a combustion chamber with front, back, top, bottom and side walls, said back wall being spaced inwardly from the ends of said bottom, top and side walls;

an auxiliary wall spaced from said back wall and attached to said top, bottom and side walls to provide an airspace between said back wall and said auxiliary wall for passage of air to be heated, an inlet near the bottom of said airspace for the entry of air into such airspace;

a plurality of heat tubes extending across the upper portion of said combustion chamber between corresponding openings in said back wall and front wall to provide passages for air from said airspace to exit from the openings in said front wall;

a baffle plate located above said plurality of heat tubes and inclined upwardly at an acute angle less than 15 degrees therefrom to increase the turbulence of combustion products from the combustion chamber as these products rise therefrom, said baffle plate overlying the major cross-sectional area of said stove over said heat tubes and being spaced from said front, back and side walls of said combustion chamber;

a flue located in said top wall substantially centered above said baffle for forming an outlet for the products of combustion;

said front wall having a rectangular opening in it located beneath the openings terminating said heat tubes and extending substantially from side to side for permitting viewing of a fire therein, if desired; and first and second doors pivotally attached on opposite sides of the rectangular opening in said front wall for cooperatively closing said rectangular opening in a closed position and for pivoting back substantially parallel to opposite side walls of said heating stove in an open position to permit use of said heating stove as a fireplace with said doors in the open position and as a heating stove with said doors in a closed position.

2. The combination according to claim 1 further including fan means for forcing air into the inlet in said airspace.

3. The combination according to claim 1 wherein said heating stove is a wood burning heating stove and further including refractory material lining at least the bottom of said heating stove.

4. The combination according to claim 3 further including an ash fender extending from the bottom of the stove outwardly perpendicularly beyond said front wall thereof.

5. The combination according to claim 1 wherein at least one of said first and second doors have an adjustable draft therein for controlling the passage of air therethrough into the combustion chamber with said first and second doors in the closed position.

6. The combination according to claim 1 wherein the edges of the rectangular opening in said front wall of said heating stove and adjacent edges of the inside surfaces of said first and second doors have cooperating flanges and channels for effectively sealing the rectangular opening in said front wall with said first and second doors in the closed position.

7. The combination according to claim 6 further including screen means removably secured in the rectangular opening in the front wall of said heating stove when said first and second doors are open and said heating stove is used as a fireplace.

8. The combination according to claim 1 wherein said baffle is rectangular and at least the edges of said baffle facing downwardly toward said combustion chamber are beveled.

9. The combination according to claim 1 wherein said baffle plate slopes upwardly from the rear to the front of said heating stove.

* * * * *